US006445343B1

(12) United States Patent
Pietrusiak

(10) Patent No.: US 6,445,343 B1
(45) **Date of Patent: *Sep. 3, 2002**

(54) ANTENNA ELEMENT ARRAY ALIGNMENT SYSTEM

(75) Inventor: Stephan Pietrusiak, Redondo Beach, CA (US)

(73) Assignee: Hughes Electronics Corporation, El Segundo, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/504,636

(22) Filed: Feb. 16, 2000

(51) Int. Cl.[7] ..... H01Q 3/22
(52) U.S. Cl. ..... 342/368; 342/173; 342/174
(58) Field of Search ..... 342/165, 173, 342/174, 369, 372, 368

(56) References Cited

U.S. PATENT DOCUMENTS

| | | | | |
|---|---|---|---|---|
| 4,618,831 A | | 10/1986 | Egami et al. | |
| 4,907,004 A | | 3/1990 | Zacharatos et al. | |
| 5,115,248 A | | 5/1992 | Roederer | |
| 5,253,188 A | * | 10/1993 | Lee et al. | 364/571.02 |
| 5,559,519 A | * | 9/1996 | Fenner | 342/174 |
| 5,864,317 A | * | 1/1999 | Boe et al. | 342/374 |
| 6,005,891 A | * | 12/1999 | Chadwick et al. | 375/224 |
| 6,127,966 A | * | 10/2000 | Ergage | 342/174 |

* cited by examiner

*Primary Examiner*—Dao Phan
(74) *Attorney, Agent, or Firm*—Gates & Cooper LLP

(57) ABSTRACT

The present invention discloses methods and an apparatus for characterizing an antenna system. The apparatus comprises a processor, a coupler, and a converter. The processor selectively injects a test signal into amplifiers in the antenna system while other amplifiers are amplifying the broadcast signal, and the amplified signals are then fed to a hybrid matrix. The coupler samples the combined amplified test and broadcast signals, and the converter converts the combined test and broadcast signals to a different frequency band to separate the test signal from the broadcast signal. The processor determines a phase response and an amplitude of the first amplifier and a phase effect of the hybrid matrix by measuring the separated test signal and modifies a phase of the broadcast signal using the determined phase response of the first amplifier and the hybrid matrix when the broadcast signal is subsequently provided to the first amplifier. The method comprises the steps of preventing a first amplifier from receiving a broadcast signal, injecting a test signal into the first amplifier, amplifying the broadcast signal by at least a second amplifier, combining the amplified test signal with the amplified broadcast signal, monitoring the combined amplified test signal, separating the combined amplified test signal to retrieve the amplified test signal, measuring the separated amplified test signal to determine a phase response of the first amplifier and a phase effect of the combining step, and modifying a phase of the broadcast signal using the determined phase response and the phase effect when the broadcast signal is subsequently provided to the first amplifier.

12 Claims, 4 Drawing Sheets

ANTENNA ELEMENT ARRAY ALIGNMENT SYSTEM

BACKGROUND OF THE INVENTION

1. Field of the Invention.

This invention relates in general to antenna systems, and in particular to an antenna element array alignment system.

2. Description of Related Art.

Communications satellites have become commonplace for use in many types of communications services, e.g., data transfer, voice communications, television spot beam coverage, and other data transfer applications. As such, satellites must provide signals to various geographic locations on the Earth's surface. Typical satellites use customized antenna designs to provide signal coverage for a particular country or geographic area.

The primary design constraints for communications satellites are antenna beam coverage, isolation, and radiated Radio Frequency (RF) power. These two design constraints are typically thought of to be paramount in the satellite design because they determine which customers on the earth will be able to receive satellite communications service. Further, the satellite weight becomes a factor, because launch vehicles are limited as to how much weight can be placed into orbit.

Many satellites operate over fixed coverage regions and employ polarization techniques, e.g., horizontal and vertical polarized signals, or circularly polarized signals, to increase the number of signals that the satellite can transmit and receive. These polarization techniques use a single unshaped parabolic mesh reflector with offset focus points to produce substantially congruent coverage regions for the polarized signals. This approach is limited because the coverage regions are fixed and cannot be changed on-orbit, and the cross-polarization isolation for wider coverage regions is limited to the point that many satellite signal transmission requirements cannot increase their coverage regions.

Many satellite systems would be more efficient if they contained antennas with high directivity of the antenna beam and had the ability to have the coverage region be electronically configured on-orbit to different desired beam patterns. These objectives are typically met using a phased array antenna system. However, phased array antennas carry with them the problems of large signal losses between the power amplifiers and the antenna horns, and difficult integration and test measurements and characterization.

During the design and test of a phased arrays system, the phased array antenna system is mated with power amplifiers, typically Solid-State Power Amplifiers (SSPAs) to determine the RF power output of the system. Although the power is directly measured during SSPA output, the SSPA is in the compression (saturation) region during this measurement. It is preferable to measure the SSPA in the linear region. The SSPA is better measured in the linear region, when there are no signals travelling through the SSPA, but this is not practical to do during testing of the spacecraft. If the SSPA is properly characterized, the Signal-to-Noise Ratio (SNR) can be improved through continuous time integration of the signal.

It can be seen, then, that there is a need in the art for antenna systems that can measure the SSPA while communications signals are travelling through the system. It can also be seen that there is a need in the art for antenna systems that are characterized properly to improve the SNR of the communications signals.

SUMMARY OF THE INVENTION

To overcome the limitations in the prior art described above, and to overcome other limitations that will become apparent upon reading and understanding the present specification, the present invention discloses methods and an apparatus for characterizing an antenna system. The apparatus comprises a processor, a coupler, and a converter. The processor selectively injects a test signal into amplifiers in the antenna system while other amplifiers are amplifying the broadcast signal, and the amplified signals are then fed to a hybrid matrix. The coupler samples the combined amplified test and broadcast signals, and the converter converts the combined test and broadcast signals to a different frequency band to separate the test signal from the broadcast signal. The processor determines a phase response of the first amplifier and a phase effect of the hybrid matrix by measuring the separated test signal and modifies a phase of the broadcast signal using the determined phase response of the first amplifier and the hybrid matrix when the broadcast signal is subsequently provided to the first amplifier.

The method comprises the steps of preventing a first amplifier from receiving a broadcast signal, injecting a test signal into the first amplifier, amplifying the broadcast signal by at least a second amplifier, combining the amplified test signal with the amplified broadcast signal, monitoring the combined amplified test signal, separating the combined amplified test signal to retrieve the amplified test signal, measuring the separated amplified test signal to determine a phase response and an amplitude of the first amplifier and a phase effect of the combining step, and modifying a phase of the broadcast signal using the determined phase response and the phase effect when the broadcast signal is subsequently provided to the first amplifier.

The present invention provides antenna systems that can measure the SSPA while communications signals are travelling through the system. The present invention also provides antenna systems that are characterized properly to improve the SNR of the communications signals.

BRIEF DESCRIPTION OF THE DRAWINGS

Referrng now to the drawings in which like reference number represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

System Overview

Figure 1:
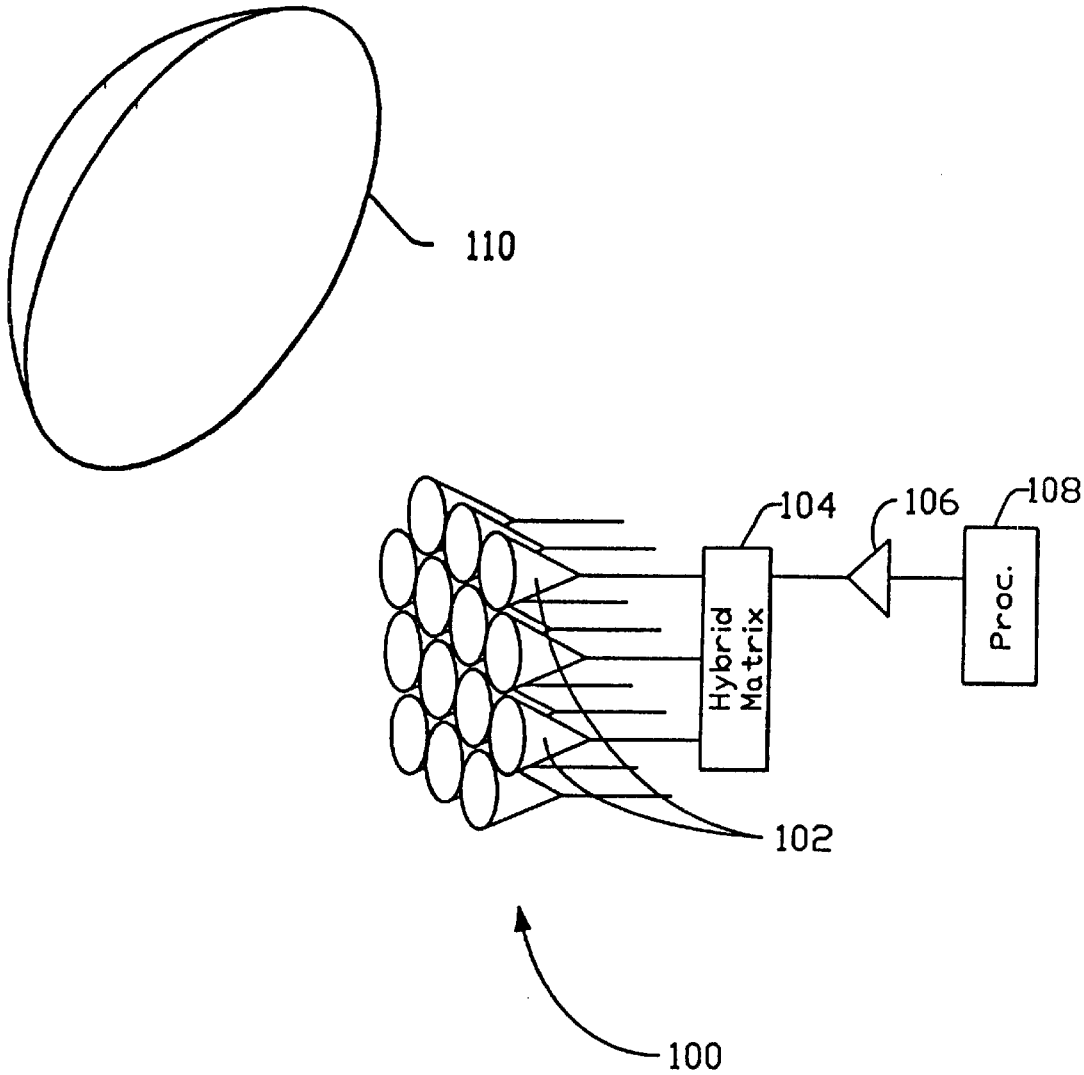
FIG. 1 illustrates a typical phased array antenna system in accordance with the present invention.

FIG. 1 illustrates a typical phased array antenna system in accordance with the present invention. System 100 comprises feed horns 102, hybrid matrix 104, High Power Amplifier (HPA) 106, and processor 108. In addition, if system 100 is a reflector array system, system 100 would also include reflector 110. Each feed horn 102 has one or more associated FPAs 106. HPA 106 can be an SSPA, Traveling Wave Tube Amplifier (TWTA), or other amplifier or amplifier system.

Each feed horn 102 and HPA 106 is provided with an input signal from the processor 108. The processor 108 has phased the input signals to the various HPA 106/feed horn 102 chains by providing beamweights, e.g., amplitude and phase information, to each of the HPA 106/feed horn 102 chains to form a phased signal such that a subset of the feed horns 102, up to and including the entire complement of feed horns 102, transmit the input signal in proper phase to provide the amplified input signal to a location distant from the antenna system 100. Typical antenna systems 100 have multiple feed horns 102, usually greater than one hundred feed horns 102. The present invention is not limited by the number of feed horns 102 in the system 100.

For an array system 100 with a large number of feed horns 102, e.g., greater than one hundred feed horns 102, the robust performance of the system 100 in terms of Effective Radiated Incident Power (EIRP) and isolation between input signals will not be deletenously affected by removing a small number of feed horns 102 from actively transmitting a given input signal. As such, a feed horn 102 and associated IPAs 106 can be removed from the active transmission of a given input signal with negligible impact to performance, i.e., only a few hundredths of a dB of EIRP degradation would be seen in such a system 100.

Figure 2:
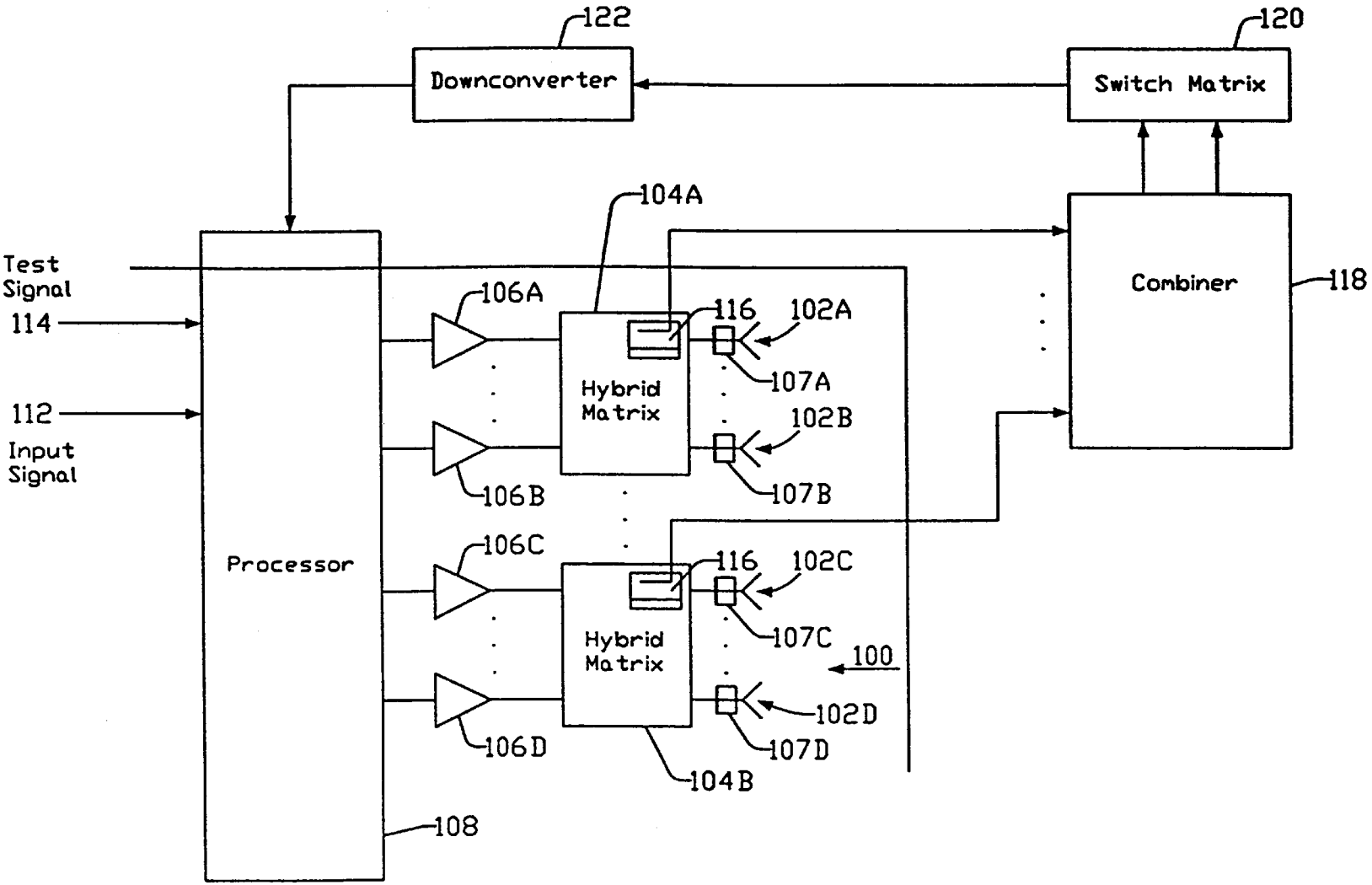
FIG. 2 illustrates a block diagram of the system of the present invention.

FIG. 2 illustrates a block diagram of the system of the present invention. System 100 is shown having multiple feed horns 102A–102D, coupled to hybrid matrices 104A–104B, and each feed horn 102A–102D having associated with it one or more HPAs 106A–106D and a diplexer 107A–107D. Typically, an input signal 112 is fed into the processor 108, or multiple processors 108. The processor 108 determines the beamweights for each HPA 106A–106D, hybrid matrices 104A–104B, and feed horns 102A–102D paths to provide a phased signal from a subset of the feed horns 102A–102D such that a properly phased signal is transmitted from the feed horns 102A–102D.

The present invention uses a test signal 114, injected into the processor 108, and a test port 116 of each hybrid matrix 104A–104B, to individually test each HPA 106A–106D in the linear region, to properly characterize the output of the system 100. The test signal 114 uses a dedicated frequency for the HPA 106A–106D under test, and the dedicated frequency is typically not within the bandwidth of the input signal 112.

As an example, the present invention turns off the input signal 112, via the processor 108, to HPA 106A. Since there are a large number of HPA 106A in the system 100, the removal of one HPA 106A from the transmission path has a minute effect on the transmission of the input signal 112.

The present invention inserts test signal 114 into HPA 106A. HPA 106A is operated in the substantially linear region. The output of HPA 106A is fed into hybrid matrix 104A, where the signal is matrixed with signals from all of the other HPAs 106A–106B coupled to hybhd matrix 104A. The test port 116 of hybrid matrix 104A uses a directional coupler to monitor this matrixed signal, which includes the test signal. This matrixed signal is then sent to a combiner 118, through a switch matrix 120, and to a downconverter 122. Since the test signal 114 is at a different frequency than the input signal 112, the output of the downconverter 122 will show the phase and amplitude of the test signal 114 separated from the input signal 112. The test signal 114 is recovered from the matrixed signal through synchronous integration over time after the test signal 114 is downconverted to direct current (DC). This allows for an adequate SNR to be obtained with the removal of the input signal 112 via filtering. The test signal 114 path through the system 100 now contains phase and amplitude information about the HPA 106A, and the hybrid matrix 104A.

The phase and amplitude information for HPA 106A is then returned to processor 108, which compares the information with previous information stored regarding HPA 106A. If the phase and amplitude information has changed, the processor 108 can adjust the beamweights, either on board the satellite or on the ground, associated with HPA 106A, or the gain of HPA 106A, or other feedback techniques can be applied to correct the phase output of the transmission path tested.

The test signal 114 can then be sent to every HPA 106A–106D in the system 100, to characterize every transmission path and every HPA 106A–106D. The test signal can be sent every frame, every minute, or, for more stable systems, less frequently, to minimize the alterations or maximize the feedback characteristics of the present invention. Further, the HPAs 106A–106D that are used to determine the beamweights using the method of the present invention can be a single HPA 106A, a subset of HPAs 106A–106D, or all of the HPAs 106A–106D in the system Interpolation can be used to determine the phase and loss contribution made by individual elements given a limited measurement technique, or a single HPA 106A can be used as a reference and all measurements and beamweights or other compensatory techniques can be made relative to the reference HPA 106A.

This comparison, along with the short time between measurements of the test signal 114, allows for a relative alignment in a given path that cancels out the effects of common calibration hardware. An adjustment is made to compensate for the changes in the hybrid matrix 104A, cabling between processor 108 and feed horn 102, and combiner 118 paths to obtain the gain of each path of the array up to the output of the hybrid matrix 104A. The gains that are measured give differences in relative phase and amplitude for the different paths. Once the differences are known, compensation is made via the beamweights in the payload processor, gain in the HPA 106A–106D chain, or other compensation throughout the antenna system 100.

In addition, a path can be measured multiple times in succession with the only difference between measurements being a change in HPA 106A output power. This can be done to place the HPA 106A in compression mode, and an input power to output power curve for each HPA 106A–106D is obtained. The effect of the common calibration hardware paths are eliminated because they are common to each measurement, and adequate SNR and a short time between measurements provide a smooth curve for each HPA 106A–106D. Relative measurements are adjusted based on the curve data to provide absolute levels for gain, phase, etc. for each HPA 106A–106D in the system 100.

The remainder of the path from hybrid matrix 104A output to feed horn 102A consists of cabling and a phase contribution of the diplexers 107A–107D. The cabling phase contribution is substantially constant and can be measured on the ground for each path. The phase contribution of diplexers 107A–107D can also be factored into the compensation, e.g., beamweights, etc., calculated by processor 108. Thermistors or other temperature measuring devices, attached to diplexers 107A–107D or a selected subset of the diplexers 107A–107D, measure the temperature of diplexers 107A–107D. The diplexer 107A has a linear phase response with respect to temperature. The phase to temperature response can be characterized during ground test, and this curve can be stored in the processors 108, or in other memory in the system 100 or elsewhere.

Once the temperature of diplexers 107A–107D has been determined, the appropriate phase response of the diplexers 107A–107D can be determined by lookup or other calculation means, and the phase response of the diplexers 107A–107D can be factored into the beamweights calculated by the processor 108. The new beamweights are then applied to the input signal 112 to properly phase the input signal 112 through the system 100. If desired, a subset of diplexers 107A–107D can be measured for temperature, and the remainder of diplexers 107A–107D in system 100 can have temperature data interpolated from the measured diplexers 107A–107D for determination of phase response.

Return Array Measurements

Figure 3:
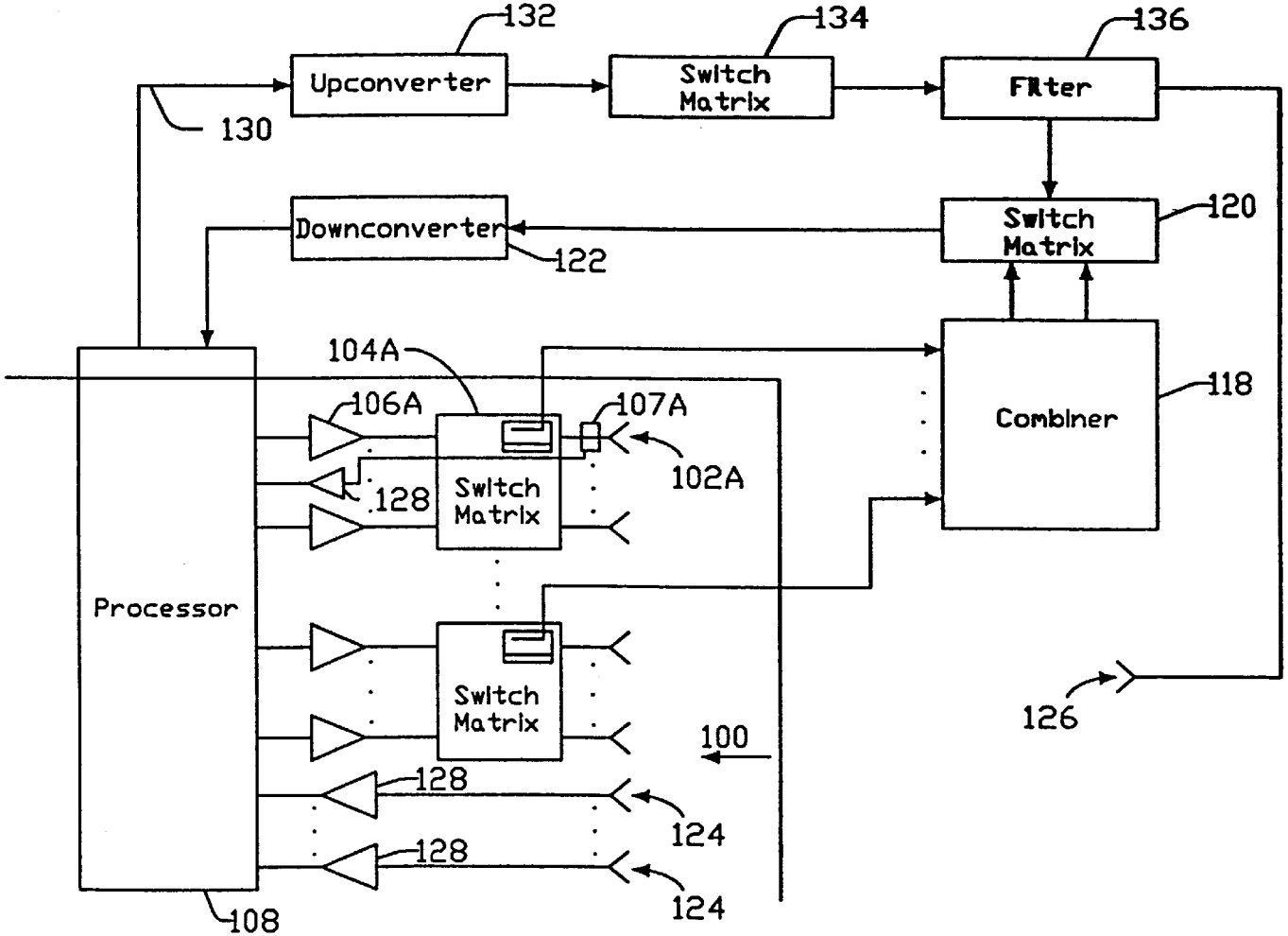
FIG. 3 illustrates the alignmnent of the return array using the present invention.

FIG. 3 illustrates the alignment of the return array using the present invention. Each of the feed horns 102, as well as the receive only horns 124, need to be properly phased for received signals as well as transmitted signals. A transmit horn 126 transmits a single receive frequency, which is out of the bandwidth of the typical received frequencies but still within the bandwidth of the receivers of system 100, to all of the feed horns 102 and the receive only horns 124. Although shown as a separate return array, the return array can be diplexed with the transmit array if desired.

The receive path of feed horns 102 is coupled through a diplexer 107A to a Low Noise Amplifier (LNA) 128. Similarly, the receive only horns 124 are coupled to LNAs 128. The signals from each feed horn 102 and receive only horn 126 are combined in the processor 108 and a receive signal is produced therefrom.

Processor 108 either generates a transmit test signal 130, or receives an input from a signal generator to create transmit test signal 130, which is upconverted to the proper bandwidth by upconverter 132. The upconverted signal is sent through switch matrix 134 and to the diplexers 107A–107D and filters 136 before being transmitted by transmit horn 126. Once received by all of the feed horns 102 and receive only horns 126, the processor 108 can determine the relative phases of each path through each feed horn 102/LNA 128 and receive only horn 126/LNA 128 pair, and compensate the receive paths through beamweights or other parameters to properly phase the incoming signals to the system 100.

One or more paths through the system 100, e.g., through feed horn 102A, can be selected as a reference path for the entire system 100. Each path can then be measured to the reference path to obtain relative measurements. Since the upconverter 132, switch matrix 134, and diplexers and filters 136 are common to all receive paths, any effect from these sources is eliminated from the measurement. The phase and amplitude transformations from the transmit horn 126 to each feed horn 102 and receive only horn 124 are characterized during ground testing, and the data is used to adjust the measurements to obtain the gain and phase of each of the system 100 paths.

Process Chart

Figure 4:
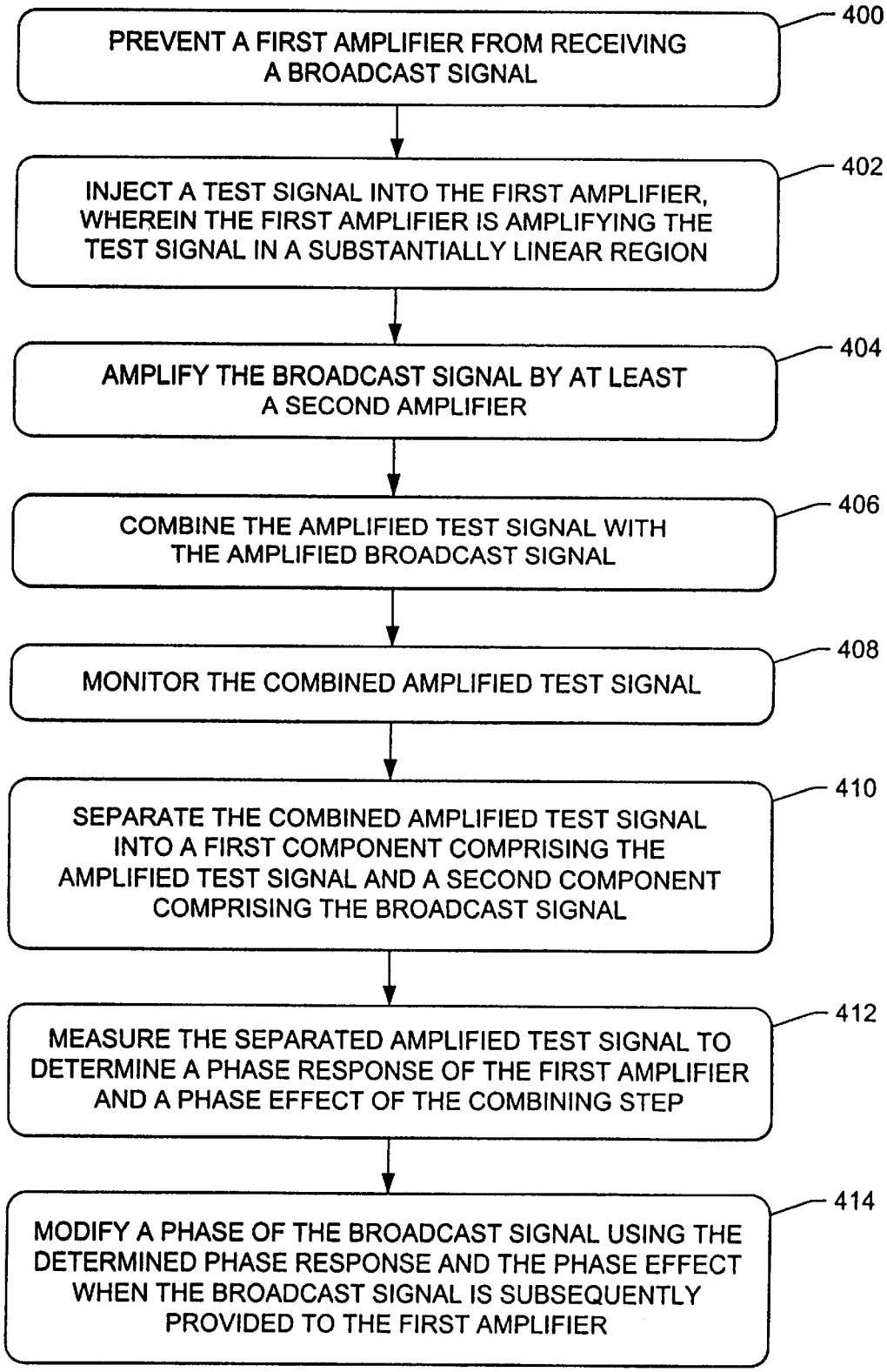
FIG. 4 is a flow chart illustrating the steps used to practice the present invention.

FIG. 4 is a flow chart illustrating the steps used to practice the present invention.

Block 400 illustrates performing the step of preventing a first amplifier from amplifying a broadcast signal.

Block 402 illustrates performing the step of injecting a test signal into the first amplifier, wherein the first amplifier is amplifying the test signal in a linear region.

Block 404 illustrates performing the step of amplifying the broadcast signal by at least a second amplifier.

Block 406 illustrates performing the step of combining the amplified test signal with the amplified broadcast signal.

Block 408 illustrates performing the step of monitoring the combined amplified test signal.

Block 410 illustrates performing the step of separating the combined amplified test signal into a first component comprising the amplified test signal and a second component comprising the broadcast signal.

Block 412 illustrates performing the step of measuring the separated amplified test signal to determine a phase response of the first amplifier and a phase effect of the combining step.

Block 414 illustrates performing the step of modifying a phase of the broadcast signal using the determined phase response and the phase effect when the broadcast signal is subsequently provided to the first amplifier.

CONCLUSION

This concludes the description of the preferred embodiment of the invention. The following paragraphs describe some alternative methods of accomplishing the same objects. The present invention, although described with respect to RF systems, can also be used with optical systems to accomplish the same goals.

In summary, the present invention discloses methods and an apparatus for characterizing an antenna system. The apparatus comprises a processor, a coupler, and a converter. The processor selectively injects a test signal into amplifiers in the antenna system while other amplifiers are amplifying the broadcast signal, and the amplified signals are then fed to a hybrid matrix. The coupler samples the combined amplified test and broadcast signals, and the converter converts the combined test and broadcast signals to a different frequency band to separate the test signal from the broadcast signal. The processor determines a phase response of the first amplifier and a phase effect of the hybrid matrix by measuring the separated test signal and modifies a phase of the broadcast signal using the determined phase response of the first amplifier and the hybrid matrix when the broadcast signal is subsequently provided to the first amplifier.

The method comprises the steps of preventing a first amplifier from receiving a broadcast signal, injecting a test signal into the first amplifier, amplifying the broadcast signal by at least a second amplifier, combining the amplified test signal with the amplified broadcast signal, monitoring the combined amplified test signal, separating the combined amplified test signal to retrieve the amplified test signal, measuring the separated amplified test signal to determine a phase response of the first amplifier and a phase effect of the combining step, and modifying a phase of the broadcast signal using the determined phase response and the phase effect when the broadcast signal is subsequently provided to the first amplifier.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A system for calibrating an antenna system, the antenna system comprising a phased array of antenna elements, comprising:

a processor for selectively injecting a test signal into a first amplifier, wherein the first amplifier amplifies the test signal in a substantially linear fashion and the first amplifier injects the amplified test signal into a hybrid matrix, while a broadcast signal is injected into a second amplifier and the amplified broadcast signal is injected into the hybrid matrix;

a coupler, coupled to the hybrid matrix, for monitoring a combined signal comprising the amplified test signal and the amplified broadcast signal; and a downconverter, coupled to the coupler, for separating the combined signal into a first component comprising the amplified test signal and a second component comprising the broadcast signal; wherein the processor determines a phase response of the first amplifier and a phase effect of the hybrid matrix by measuring the separated test signal and modifies a phase of the broadcast signal using the determined phase response of the first amplifier and the hybrid matrix when the broadcast signal is subsequently provided to the first amplifier.

2. The system of claim 1, further comprising a diplexer having a temperature measuring device coupled to the diplexer, the diplexer being coupled to an output of the hybrid matrix, wherein the processor further modifies the phase of the broadcast signal using the measured temperature of the diplexer when the broadcast signal is subsequently introduced into the diplexer.

3. The system of claim 1, wherein the test signal is injected into the second amplifier after being injected into the first amplifier, the processor measures the separated test signal to determine a phase response of the second amplifier and the phase effects of the hybrid matrix, and modifies a phase of the broadcast signal using the determined phase response when the broadcast signal is subsequently introduced into the second amplifier.

4. The system of claim 1, wherein the test signal is repeatedly injected into the first amplifier with a change in test signal power between injections to determine a phase and an amplitude response of the first amplifier.

5. A system for characterizing an antenna system, comprising:

a test signal injected into the antenna system by a transmission horn, wherein the test signal is injected substantially simultaneously to all receiving elements of the antenna system;

an upconverter, for converting the test signal from a first frequency to a second frequency, the second frequency being within a frequency range of the elements of the antenna system; and a processor for determines a phase response of the elements of the antenna system by measuring the upconverted test signal at each receiving element input to the processor and modifies a phase of the receiving elements using the determined phase response of the elements of the antenna system.

6. The system of claim 5, wherein the processor generates the test signal at the first frequency.

7. A method for characterizing an array of antenna elements, comprising the steps of:

preventing a first amplifier from receiving a broadcast signal;

injecting a test signal into the first amplifier, wherein the first amplifier is amplifying the test signal in a substantially linear region;

amplifying the broadcast signal by at least a second amplifier, combining the amplified test signal with the amplified broadcast signal;

monitoring the combined amplified test signal;

separating the combined amplified test signal into a first component compromising the amplified test signal and a second component comprising the broadcast signal;

measuring the separated amplified test signal to determine a phase response of the first amplifier and a phase effect of the combining step; and modifying a phase of the broadcast signal using the determined phase response and the phase effect when the broadcast signal is subsequently provided to the first amplifier.

8. The method of claim 7, further comprising the steps of measuring a temperature of a diplexer that receives the combined amplified test signal; and further modifying the phase of the broadcast signal using the measured temperature of the diplexer when the broadcast signal is subsequently introduced into the diplexer.

9. The method of claim 7, further comprising the steps of:

preventing a second amplifier from amplifying a broadcast signal;

injecting a test signal into the second amplifier, wherein the second amplifier is amplifying the test signal in a linear region;

combining the amplified test signal with the broadcast signal being amplified by an amplifier other than the second amplifier;

sampling the combined amplified test signal;

separating the combined amplified test signal into a first component comprising the amplified test signal and a second component comprising the broadcast signal;

measuring the separated amplified test signal to determine a phase response of the second amplifier and a phase effects of the combining step; and modifying a phase of the broadcast signal using the determined phase response when the broadcast signal is subsequently introduced into the second amplifier.

10. The method of claim 7, wherein the steps of preventing a first amplifier from amplifying a broadcast signal and injecting a test signal into the first amplifier are repeated for the first amplifier, with an increase in a power of the test signal between each pair of steps to determine a phase response and an amplitude of the first amplifier.

11. A method for characterizing an antenna system having a plurality of elements, comprising the steps of:

converting a test signal from a first frequency to a second frequency, the second frequency being within a frequency range of the elements of the antenna system;

injecting the test signal into the antenna system via a transmission horn, wherein the test signal is injected substantially simultaneously to substantially all receiving elements of the antenna system;

determining a phase response of the elements of the antenna system by measuring the converted test signal at each receiving element input to the processor; and modifying a phase of the receiving elements using the determined phase response of the elements of the antenna system.

12. The method of claim 11, wherein the antenna system is a phased array antenna system.

* * * * *